US007227068B1

(12) United States Patent
Van Doren

(10) Patent No.: US 7,227,068 B1
(45) Date of Patent: Jun. 5, 2007

(54) STRING-MOUNTED CONDITIONER FOR STRINGED MUSICAL INSTRUMENTS

(76) Inventor: Clayton Lee Van Doren, 5787 Ryan Rd., Medina, OH (US) 44256

( * ) Notice: Subject to any disclaimer, the term of this patent is extended or adjusted under 35 U.S.C. 154(b) by 600 days.

(21) Appl. No.: 10/847,264

(22) Filed: May 17, 2004

(51) Int. Cl.
*G10D 3/14* (2006.01)

(52) U.S. Cl. ..... 84/297 R

(58) Field of Classification Search ..... 84/298–302, 84/297 R, 294, 313, 453
See application file for complete search history.

(56) References Cited

U.S. PATENT DOCUMENTS 579,605 A 3/1897 Pierce
1,352,442 A 9/1920 Floresco
1,467,576 A 9/1923 Flydal
1,539,961 A * 6/1925 Scott ..... 84/294
2,911,872 A 11/1959 Carl
3,407,696 A * 10/1968 Smith et al. ..... 84/297 R
4,688,460 A * 8/1987 McCoy ..... 84/724
4,762,046 A * 8/1988 Aspri et al. ..... 84/294
5,031,501 A 7/1991 Ashworth
5,438,158 A * 8/1995 Riboloff ..... 84/267
5,537,908 A 7/1996 Rabe
5,600,081 A 2/1997 Simjian
5,661,252 A * 8/1997 Krawczak ..... 84/291
5,986,190 A * 11/1999 Wolff et al. ..... 84/297 R

* cited by examiner

*Primary Examiner*—Briggitte R. Hammond

(57) ABSTRACT

A device (10) for conditioning a stringed musical instrument (20), comprising a vibrator (30) mounted on a transverse supporting member (14) which attaches removably to one or more strings (26) of the instrument and makes no other contact with the instrument. The vibrations produced by the device are transmitted via the normal mechanical chain from the strings (26) to the bridge (24) to the sounding board (22) of the instrument.

15 Claims, 4 Drawing Sheets

STRING-MOUNTED CONDITIONER FOR STRINGED MUSICAL INSTRUMENTS

CROSS REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

This invention relates to musical instrument accessories, specifically to musical instrument accessories that condition, break-in, or artificially age stringed musical instruments for the purposes of improving the sound of such instruments.

2. Discussion of Prior Art

It is widely and commonly known that stringed musical instruments with wooden sounding boards, and often wooden bodies; such as instruments in the guitar, mandolin, and violin families; require extended periods of playing before they acquire their best sound. The process by which the sound improves with playing is known variously as breaking-in, aging, or conditioning. New or little-used instruments are characterized by tones that lack the sustain, depth, volume and clarity of well-used instruments. The sound improves as the instrument is played due to the sustained transmission of vibrations from the instrument's strings to the wooden sounding board of the instrument and the effects of these vibrations on the structure and mechanical characteristics of the wood and the instrument finish.

The problem posed by slow conditioning is that an instrument buyer cannot know how an instrument will sound in the long term if the instrument is purchased new and unplayed. This uncertainty makes it difficult to compare instruments critically, and the buyer must wait for an extended period of time until the instrument achieves its optimum sound. A performer may also need to defer playing a newly purchased instrument on stage until after the conditioning period is complete and the instrument's sound has stabilized. Likewise, an instrument manufacturer cannot fully evaluate the quality of their product, and a retailer cannot present new instruments to their best advantage.

The only method currently available for accelerating the conditioning process is to place the instrument near a loudspeaker and to allow the sounding board and body of the instrument to be vibrated by the sound pressure waves emanating from the loudspeaker. This process is being applied on a manufacturing scale by the Boucher Guitar Company (Rock Forest, Quebec, Canada) to treat unfinished guitar tops prior to final assembly and finishing. The guitar tops are exposed to music played within an acoustic chamber 24 hours a day (for an unspecified period) prior to construction of the guitar. These air-coupled vibrations, however, are weak, inefficient, and have unknown effectiveness.

There are no commercially-available devices that directly and efficiently apply vibrations to the sounding board or body of stringed instruments. Several patents have been issued, however, for devices claiming to accelerate instrument conditioning, again for the purpose of achieving optimum tone in relatively little time.

U.S. Pat. No. 2,911,872 to Carl 1959, U.S. Pat. No. 1,467,576 to Flydal 1923, and U.S. Pat. No. 579,605 to Pierce 1897, are similar in that all describe large, motor-driven, mechanical devices that automatically play one or more intact violins by drawing a bow or a belt across the strings in a reciprocating motion. The devices are intended to mimic the mechanics of actual playing and do apply vibrations to intact instruments via the normal sound-transduction mechanical chain from strings to bridge to sounding board, but are only appropriate for instrument manufacturers. The large, expensive, stationary devices are not accessible to the instrument consumer or retailer.

U.S. Pat. No. 1,352,442 to Floresco 1920, also addresses violin conditioning, but the invention treats only the top of the instrument removed from the body. The Floresco invention uses exaggerated static stresses applied to the instrument bridge by heavy-duty metal strings stretched across a frame external to the treated portion of the instrument. The invention exposes the violin top to stresses never encountered during normal use and is only suitable for use by violin manufacturers, and also.

The inventions described in patents U.S. Pat. No. 5,537,908 to Rabe 1994 and U.S. Pat. No. 5,600,081 to Simjian 1995 are intended to improve the tone of wooden instruments, but again by subject the instrument to an industrial treatment suitable only for manufacturing environments. The Rabe invention attaches the instrument or parts of an instrument to a vibrating surface or table and subjects the attached components to a range of vibration frequencies. Since the whole instrument or instrument parts are shaken, the applied vibrations bypass the normal mechanical chain from the strings to the bridge to the soundboard. Consequently, the treatment risks damage to components not intended to sustain vibrations and may or may not treat all the components that are intended to vibrate in normal use. The Simjian invention suffers the same shortcomings and risks since it submerges wood panels destined for use as instrument parts in an ultrasonic bath.

U.S. Pat. No. 5,031,501 to Ashworth, 1991 Jul. 16, is the most relevant to the present application and describes the only device that is portable, that attaches to a complete instrument, and that could be used by an instrument consumer. The Ashworth invention comprises an audio transducer attached to a guitar in which the tension of the strings presses down on an arm of the device which, in turn, presses a foot extending from the transducer directly against the sounding board. The strings are used only to hold the invention in place while the audio transducer applies vibrations directly to the sounding board via a rigid mechanical coupling.

Although the multiple patents described above emphasize the importance of and attempt to address the need for conditioning new or little-used string instruments with wood sounding boards or bodies, all of the inventions suffer from one or more disadvantages.

(a) Most of the inventions constitute industrial or manufacturing treatments that are not suitable for use by the instrument consumer. In particular, the inventions
- are large, bulky, and stationary
- are expensive
- are not easily applied
- are not designed to be attached and removed easily or frequently
- are not suitable for unattended use
- do not apply vibrations through the normal mechanical chain or do not apply vibrations or stresses normally encountered during play (b) Most of the inventions are designed for instruments in the violin family only and are not applicable to instruments that are plucked rather than bowed, such as those in the guitar and mandolin families.

(c) The only invention that is suitable for use by the instrument consumer is relatively difficult to remove and attach has multiple moving parts necessary for attachment and adjustment makes mechanical contact with the sounding board and thus exposes the sounding board to physical damage makes mechanical contact with the sounding board and thus bypasses the normal sound transduction mechanical chain from strings to bridge to sounding board makes mechanical contact with the sounding board and thus may not vibrate all components of the instrument that normally experience vibration, or may vibrate components of the instrument that do not normally experience vibration tends by its design to lift strings off of the instrument bridge, which may lead to movement of the bridge for instruments with bridges not fixed to the body such as violins, mandolins, and arch-top guitars requires an unspecified source of amplified audio signals to drive the audio transducer The disadvantages and deficiencies of these previous inventions may be responsible for the complete absence of any commercially-available stringed instrument conditioner.

OBJECTS AND ADVANTAGES

Several objects and advantages of the present invention are:

(a) to provide for stringed musical instruments a means of conditioning that accelerates the break-in or conditioning process, minimizing the time required for the instrument to achieve optimal tone;

(b) to provide for stringed musical instruments a means of conditioning that is small, inexpensive, and highly portable;

(c) to provide for stringed musical instruments a means of conditioning that is easily attached and removed from the instrument;

(d) to provide for stringed musical instruments a means of conditioning that can be used while the instrument is unattended;

(e) to provide for stringed musical instruments a means of conditioning that can be manufactured and distributed to the instrument consumer as an inexpensive musical instrument accessory;

(f) to provide for stringed musical instruments a means of conditioning that can be used with a wide variety of instruments, including those in the guitar, mandolin, and violin families;

(g) to provide for stringed musical instruments a means of conditioning that can be used by instrument manufacturers or retailers as a standard and economical treatment of new instruments;

(h) to provide for stringed musical instruments a means of conditioning that attaches only to the strings of the instrument and that does not contact any other part of the instrument so that the applied vibrations activate the mechanical system normally, thereby mimicking actual playing to maximize the effect of treatment while minimizing the potential risk of damage;

(i) to provide for stringed musical instruments a means of conditioning that attaches only to the strings of the instrument but does not change the coupling of the strings to the instrument bridge;

(j) to provide for stringed musical instruments a means of conditioning that requires only external power and no additional electrical components or signal processing to maximize its effectiveness as a musical instrument accessory;

Further objects and advantages of my invention will become apparent from a consideration of the drawings and ensuing description.

SUMMARY

In accordance with the present invention a portable and removable device for conditioning stringed musical instruments comprises a means for producing mechanical vibrations and applying those vibrations to the instrument strings without contacting any other part of the musical instrument.

DRAWINGS—FIGURES

Closely related figures have the same number but different alphabetic suffixes.

FIG. 7A shows a removable cable design, FIG. 7B shows the strain relief molded as an integral part of a contoured housing, and FIG. 7C shows a housing with rectangular faces and cross-section.

Figure 8A:
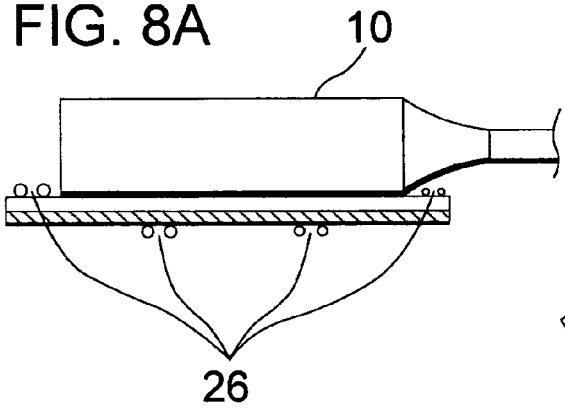
Figure 8B:
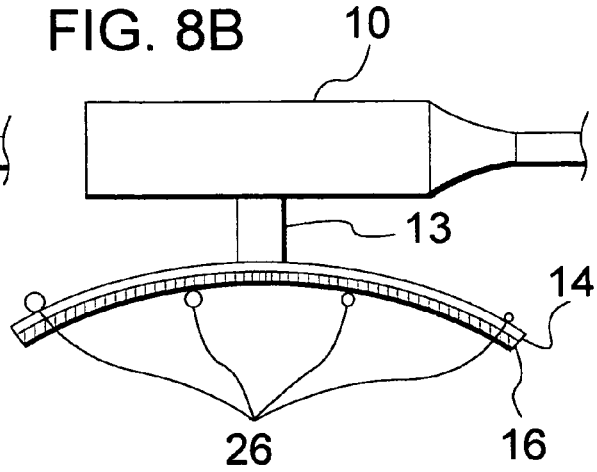
Figure 8C:
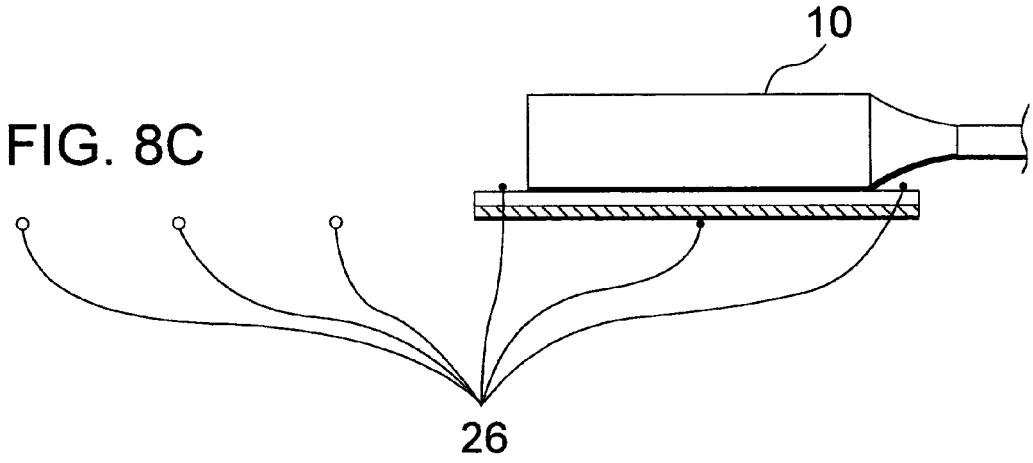

FIGS. 8A to 8C show different embodiments of the string instrument conditioner. FIG. 8A shows an embodiment appropriate for an instrument in the mandolin family. FIG. 8B shows an embodiment appropriate for an instrument in the violin family. FIG. 8C shows an embodiment appropriate for using a subset of the strings of an instrument in the guitar family.

DRAWINGS - REFERENCE NUMERALS

| | |
|---|---|
| 10 | stringed instrument conditioner |
| 12 | protective housing |
| 13 | protective housing standoff |
| 14 | transverse supporting member |
| 16 | friction enhancement layer |
| 17 | power cable strain relief |
| 18 | power cable |
| 19 | power cable connector |
| 20 | stringed musical instrument (guitar) |
| 22 | sounding board |
| 24 | bridge |
| 26A-F | instrument strings |
| 30 | electrically-activated vibrator |
| 32 | motor |
| 34 | motor shaft |
| 36 | cam |
| 38 | motor power leads |

DETAILED DESCRIPTION—PREFERRED EMBODIMENT—FIGS. 1 THROUGH 5

A preferred embodiment of the stringed instrument conditioner is illustrated in FIGS. 1-5. Like numerals indicate like parts throughout the several views. The stringed instrument conditioner according to the present invention is designated generally in the figures by the numeral 10, the stringed musical instrument by the numeral 20, and the vibrator that is part of conditioner 10 by the numeral 30. In the preferred embodiment, the stringed musical instrument is a guitar.

The stringed instrument conditioner 10 comprises an electrically activated vibrator 30 inside a protective housing 12 attached to a single transverse supporting member 14. The conditioner 10 is removably attached to the strings 26A-26F (referred to collectively when appropriate as 26) of guitar 20, and makes no other contact with guitar 20. Electrical activation of vibrator 30 within the conditioner 10 imparts vibrations to the strings 26 of guitar 20 and thence to the instrument sound board 22 via the normal attachment of strings 26 to guitar bridge 24.

The vibrator 30 in the preferred embodiment consists of a motor 32 with a cam 36 attached to the motor shaft 34; as commonly used in pagers and available, for example, from American Science & Surplus of Skokie, Ill. In the preferred embodiment, vibrator 30 is connected to its power source (not shown in the figures) by power leads 38 which are protected within cable 18 which inserts into protective housing 12 through a molded, compliant strain relief 17. The motor 32 typically requires roughly 1.5 volts DC and about 100 mA. The power source may be one or more batteries, rechargeable or not, for short-term use; or a conventional wall-plug AC-to-DC power converter of suitable rating for long-term use. For certain applications it may be feasible to use rechargeable batteries contained within protective housing 12 obviating the need for power cable 18 except during periods of battery recharging.

Vibrator 30 is typically of cylindrical shape, and is roughly 20 mm long and 6 mm in diameter. Vibrator 30 is enclosed in any suitable protective housing 12 that allows rotation of cam 36 and that can be attached fixedly to transverse member 14. Protective housing 12 may then be made from any suitable tubing with an inner diameter also of at least 6 mm, and vibrator 30 may be held in place by friction, a suitable adhesive, or mechanical stops. The length of the housing may range from a minimum length equal to the length of the vibrator to a maximum length equal to the distance separating the two outermost strings 26A and 26F. In the preferred embodiment, protective housing 12 is a 47 mm×7 mm OD (6.7 mm ID) cylindrical brass tube that is soldered, welded, brazed or glued using conventional means to the transverse member 14.

The transverse supporting member 14 is typically as wide as protective housing 12, and must be longer than the distance separating the two outermost strings 26A and 26F. In the preferred embodiment, transverse supporting member 14 is made of brass and is approximately 6 mm wide, 57 mm long, and 0.7 mm thick. A friction enhancement layer 16 made of rubber or other suitable material is cemented to the underside of transverse member 14 to increase the friction between the strings 26B-26E and the conditioner 10.

OPERATION OF INVENTION

The transverse supporting member 14 is interposed between the strings 26, being removably held in place, urged downward against the middle four strings 24B through 24E by the tension of the two most lateral strings 26A and 26F, and urged upward against the two most lateral strings by the tension of the middle four strings. The transverse member 14 thus is held removably in place by the friction between it and the strings 26. The friction, and hence the stability of the conditioner, is increased by the rubber friction enhancement layer 16.

The string instrument conditioner 10 is placed by inserting one end of transverse supporting member 14 under one of the most lateral strings, either 26A or 26F, and then sliding the opposite end of transverse supporting member 14 under the other outside string while keeping the conditioner 10 over the middle four strings 24B-24E. No other form of attachment is necessary. The normal string spacing is not altered, and no part of conditioner 10 contacts any element, component or surface of the instrument other than the strings. The conditioner 10 may be placed at any suitable location along the strings of the musical instrument. The conditioner 10 is removed by pulling it transverse to the strings until one of its ends is free from either of the most lateral strings 26A or 26F. The conditioner 10 may then be lifted free of the instrument by tilting it slightly and slipping its opposite end from under the other most lateral string.

When the conditioner 10 is in place, it is operated simply by providing suitable electrical power for as long as conditioning is desired. The timing of the treatments is arbitrary and can be adjusted to satisfy the needs or schedules of the instrument owner, retailer, or manufacturer.

The amplitude and frequency of the vibrations may be altered by changing the power supply voltage within a suitable range, by changing the mass or dimensions of the rotating cam 36, or by changing the tension of one or more strings. Large amplitude vibrations are also possible if one or more of the strings 26 are tuned so that the natural frequency of the mechanical system consisting of the conditioner 10 and the strings 26 matches the frequency of the vibrator 30.

The conditioner applies vibrations to the sounding board of the stringed instrument while contacting only the instrument strings. The applied vibrations are transmitted through the normal mechanical chain of strings to bridge to sounding board, and accelerate the breaking-in of the stringed instrument so that optimal tone is achieved in less time than would be required were the stringed instrument played manually.

DESCRIPTION AND OPERATION OF ALTERNATIVE EMBODIMENTS—FIGS 6-8

Figure 6A:
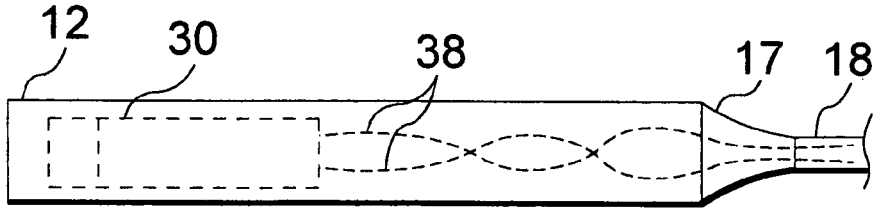
FIGS. 6A to 6C show different placements of the vibrator within the protective housing.
Figure 6B:
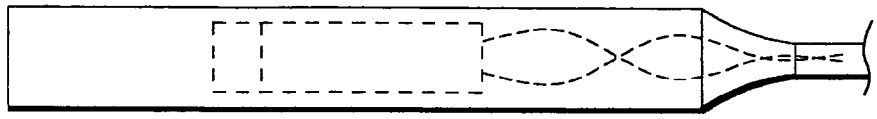
Figure 6C:
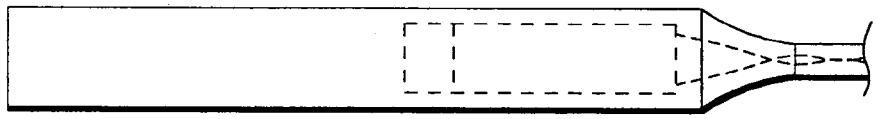

In the preferred embodiment, vibrator 30 is shorter than protective housing 12. Consequently, vibrator 30 may be placed at different positions within protective housing 12, as shown in FIGS. 6A-6C. The effect of changing the placement of the vibrator is to change the distribution of mass within conditioner 10, and hence change the movement trajectory of the conditioner in each vibration cycle. Changing the movement trajectory changes the amplitude of vibrations experienced by each string, allowing a subset of strings, and thus a portion of the sounding board, to be conditioned selectively.

Figure 7A:
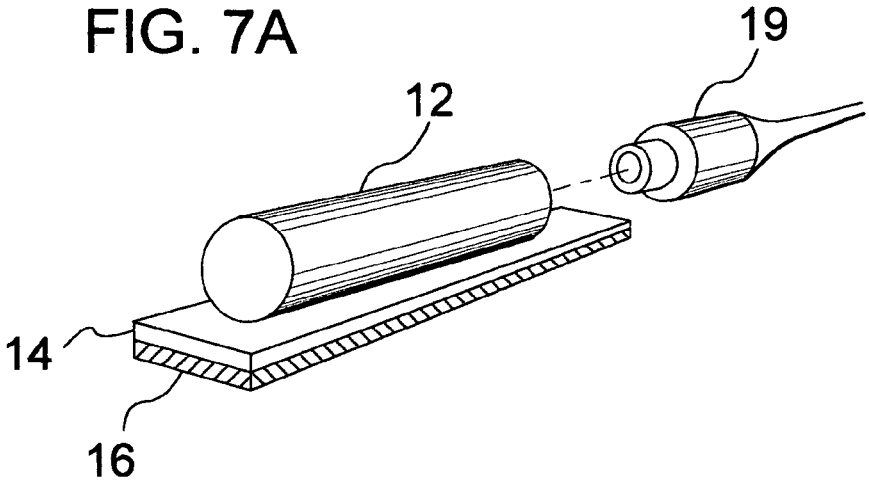
FIGS. 7A to 7C show different embodiments of the protective housing and power cable attachment.
Figure 7B:
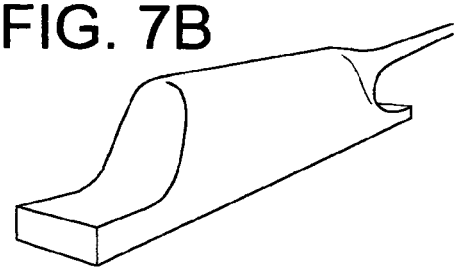
Figure 7C:
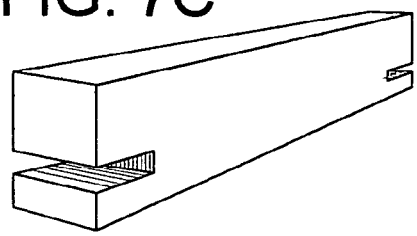

The protective housing 12 may have many different forms, a few of which are illustrated in FIGS. 7A-C. The housing may be made of any suitable material such as metal, wood, or plastic that is aesthetically pleasing and will prevent damage to the vibrator 30 if the conditioner 10 is dropped. The housing 12 may support a connector 19 for a detachable power supply (FIG. 7A). The housing 12 may also incorporate the transverse supporting member 14, the friction enhancement layer 16, and the strain relief 17 as integral parts (FIG. 7B), particularly if the housing is molded from soft plastic or hard rubber. The housing 12 may also have a variety of cross-sectional shapes to achieve specific stylistic demands or functional requirements such as a particular distribution of mass or a snag-free exterior surface (FIG. 7C).

Figure 1:
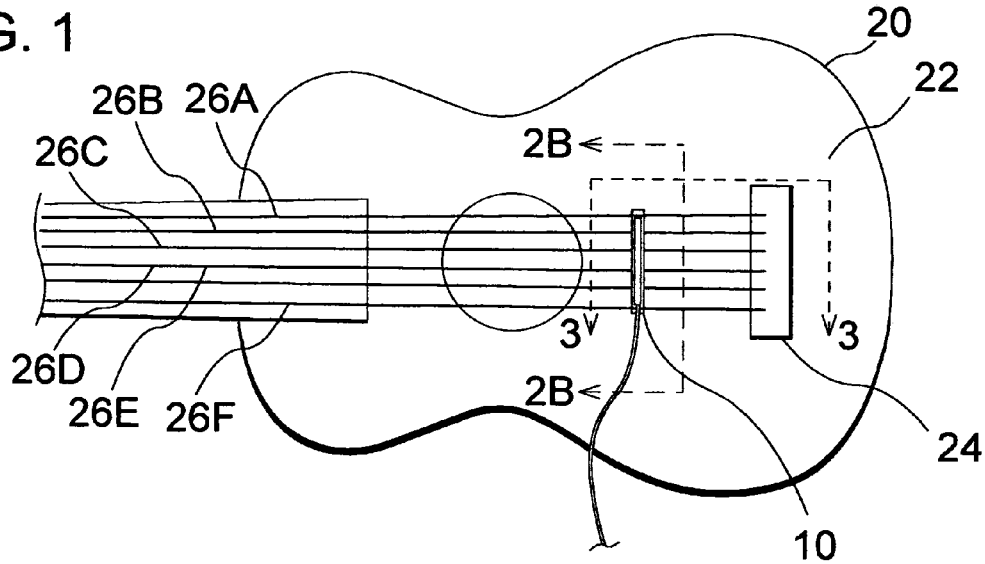
FIG. 1 shows a top view of the stringed instrument conditioner removably attached to the strings of a guitar.
Figure 2A:
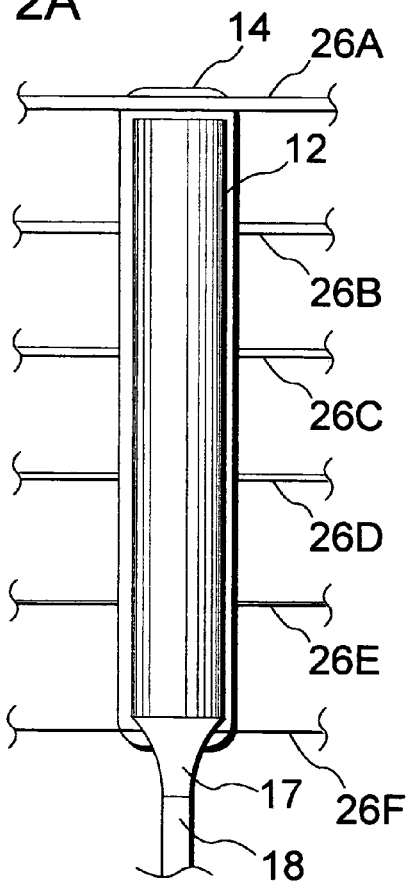
FIG. 2A is a detail sectional view similar to a portion of FIG. 1 but on a larger scale.
Figure 2B:
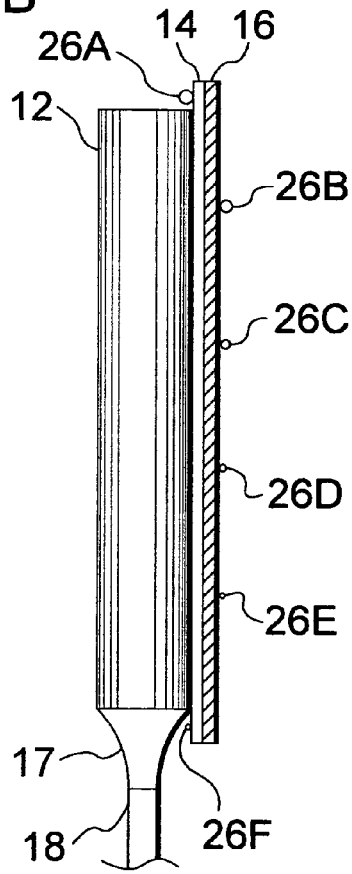
FIG. 2B is a transverse vertical section on the line 2B-2B in FIG. 1.
Figure 3:
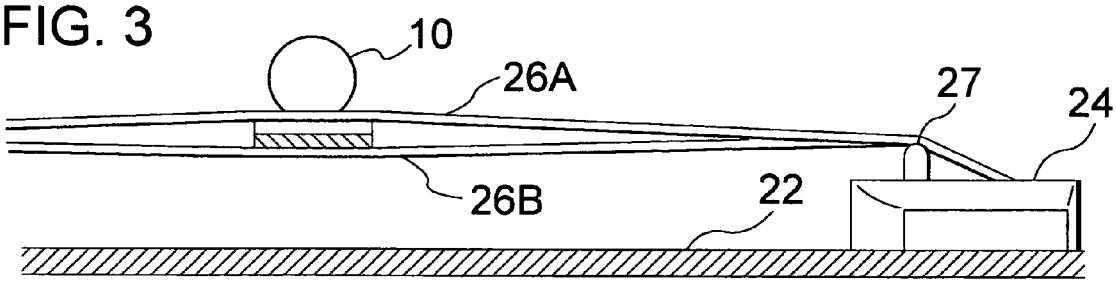
FIG. 3 is a transverse vertical section on the dotted line 3-3 in FIG. 1.
Figure 4:
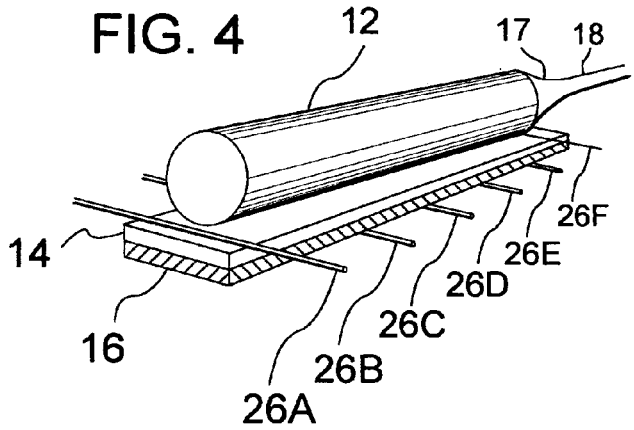
FIG. 4 is a perspective view summarizing FIGS. 2 and 3.
Figure 5A:
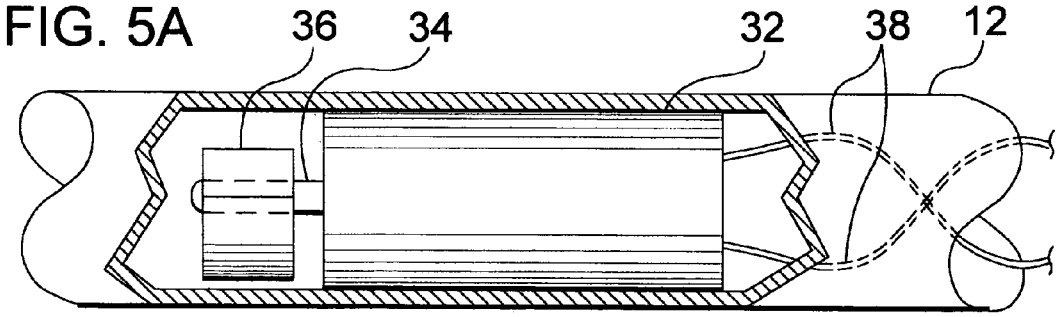
FIG. 5A is a cutaway view of the portion of the protective housing containing the vibrator.
Figure 5B:
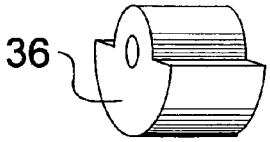
FIG. 5B is a perspective view of the cam.

The size and configuration of the conditioner may be altered to allow its placement and use on different musical instruments. Representative drawings similar in perspective to FIG. 2B are shown for conditioning any instrument in the mandolin family (FIG. 8A), the violin family (FIG. 8B), requiring a curved transverse supporting member, and for conditioning a subset of strings of a guitar (FIG. 8C). FIG. 8B also illustrates an additional modification of the conditioner configuration in which the protective housing 12 containing the vibrator 30 is elevated above transverse supporting member 14 by standoff 13 in order to amplify the vibration amplitude by mechanical leverage.

CONCLUSION, RAMIFICATIONS, AND SCOPE OF INVENTION

The reader will appreciate that the conditioner of the invention provides a simple, safe, portable, removable, economical, unobtrusive and natural method for applying vibrations to the soundboard of a stringed musical instrument. Although the description above contains many specificities, these should not be construed as limiting the scope of the invention but as providing illustrations of some of the presently preferred embodiments of this invention. Many other variations are possible. For example, the conditioner can have separable vibration and attachment modules so that one vibrator can be used with a plurality of transverse supporting members each designed for a specific stringed instrument. The conditioner can utilize alternative methods of producing vibrations including piezoelectric transducers. The conditioner can be fabricated in a plurality of materials and colors or with interchangeable covers to satisfy aesthetic demands. The conditioner can be designed for other stringed instruments not included in the violin, mandolin and guitar families. The conditioner can be made larger or smaller than the size described in the preferred embodiment. The conditioner can have an adjustable power supply to permit changes of and optimization of vibration frequency and amplitude, or a power supply with a built in timer to control the duration of the treatment. The conditioner can also be driven with an external signal to provide explicit control of vibration frequency or to permit use of multiple frequencies.

Accordingly, the scope of the invention should be determined by the following claims and their legal equivalents, rather than by the examples given.

I claim:

1. A device for conditioning a stringed musical instrument, comprising:

a. a supporting member attaching removably to one or more strings of said instrument and making no other contact with said musical instrument, and b. a means for producing mechanical vibrations, mounted on said supporting member and making no contact with said musical instrument, whereby mechanical vibrations produced by said means for producing mechanical vibrations will be transmitted to said strings and thereby to the body of said musical instrument.

2. The device of claim 1 wherein said musical instrument is selected from the group consisting of all members of the guitar family, all members of the violin family, and all members of the mandolin family.

3. The device of claim 1 wherein said means for producing mechanical vibrations comprises a direct current motor, a drive shaft of said motor, and an asymmetric cam attached to said motor by way of said drive shaft.

4. The device of claim 1 wherein said means for producing mechanical vibrations is placed in a protective housing.

5. The device of claim 4 wherein said protective housing is made of a material selected from the group consisting of metal, plastic, ceramic and wood.

6. The device of claim 1 wherein said support member is attached transversely across two or more strings of said instrument.

7. The device of claim 1 wherein said support member is attached longitudinally along one or more strings of said instrument.

8. A musical accessory for artificially aging a stringed musical instrument, comprising:

a. a supporting member attaching to one or more strings of said instrument and making no other contact with said musical instrument, and b. a vibrator mounted on said supporting member and making no contact with said musical instrument, whereby mechanical vibrations produced by said vibrator will be transmitted to said strings and thereby to the body of said instrument.

9. The device of claim 8 wherein said musical instrument is selected from the group consisting of all members of the guitar family, all members of the violin family, and all members of the mandolin family.

10. The device of claim 8 wherein said means for producing mechanical vibrations comprises a direct current motor, a drive shaft of said motor, and an asymmetric cam attached to said motor by way of said drive shaft.

11. The device of claim 8 wherein said means for producing mechanical vibrations is placed in a protective housing.

12. The device of claim 11 wherein said protective housing is made of a material selected from the group consisting of metal, plastic, ceramic and wood.

13. The device of claim 8 wherein said support member is attached transversely across two or more strings of said instrument.

14. The device of claim 8 wherein said support member is attached longitudinally along one or more strings of said instrument.

15. A method for conditioning a stringed musical instrument, comprising:

a. attaching a supporting member to one or more strings of said instrument and making no other contact with said musical instrument, and b. activating a vibrator, mounted on said supporting member and making no contact with said musical instrument, thereby transmitting the mechanical vibrations from said vibrator to said strings and thereby to the body of said instrument.

* * * * *